US009576717B2

(12) United States Patent
Persson et al.

(10) Patent No.: US 9,576,717 B2
(45) Date of Patent: Feb. 21, 2017

(54) PLANAR TRANSFORMER

(71) Applicant: Telefonaktiebolaget L M Ericsson (publ), Stockholm (SE)

(72) Inventors: Oscar Persson, Kalmar (SE); Magnus Karlsson, Oskarshamn (SE)

(73) Assignee: Telefonaktiebolaget L M Ericsson (publ), Stockholm (SE)

( * ) Notice: Subject to any disclaimer, the term of this patent is extended or adjusted under 35 U.S.C. 154(b) by 0 days.

(21) Appl. No.: 13/810,288

(22) PCT Filed: Dec. 19, 2012

(86) PCT No.: PCT/EP2012/076119
§ 371 (c)(1),
(2) Date: Jan. 15, 2013

(87) PCT Pub. No.: WO2014/094841
PCT Pub. Date: Jun. 26, 2014

(65) Prior Publication Data

US 2014/0167901 A1 Jun. 19, 2014

(51) Int. Cl.
*H01F 5/00* (2006.01)
*H01F 7/06* (2006.01)
(Continued)

(52) U.S. Cl.
CPC ..... *H01F 27/2804* (2013.01); *H01F 27/323* (2013.01); *H01F 41/041* (2013.01); *Y10T 29/4902* (2015.01)

(58) Field of Classification Search
CPC ..... H01F 27/2804; H01F 38/14; H01F 2027/2819; H01F 2077/0073; H01F 27/28; H01F 17/0013; H04B 5/0037; H04B 5/0081; H04B 5/0087; H04B 5/0093
(Continued)

(56) References Cited

U.S. PATENT DOCUMENTS 5,716,713 A * 2/1998 Zsamboky ..... C04B 41/0072 336/182
6,054,914 A 4/2000 Abel et al.
(Continued)

FOREIGN PATENT DOCUMENTS

CN 201 717 110 U 1/2011
GB 2 295 728 6/1996
(Continued)

OTHER PUBLICATIONS

International Search Report and Written Opinion Corresponding to International Application No. PCT/EP2012/076119; Date of Mailing: Sep. 18, 2013; 11 Pages.
(Continued)

*Primary Examiner* — Alexander Talpalatski
*Assistant Examiner* — Joselito Baisa
(74) *Attorney, Agent, or Firm* — Myers Bigel, P.A.

(57) ABSTRACT

A multi-layered printed circuit board, PCB, includes first windings for a first side of a planar magnetic transformer and second windings for a second side of the planar magnetic transformer. The PCB further includes conductive layers configured as the first windings, conductive layers configured as the second windings, and layers of an isolation material. Each layer of the isolation material is arranged between two conductive layers to provide electrical isolation between the two conductive layers. A group of two or more adjacent conductive layers are all conductive layers of the first windings and are all arranged between two conductive layers of the second windings. The thickness of the isolation material between the group of adjacent conductive layers of the first windings is less than the thickness of the isolation material between a conductive layer of the second windings and a conductive layer of the first windings.

10 Claims, 9 Drawing Sheets

(51) Int. Cl.

| | |
|---|---|
| ***H01L 27/08*** | (2006.01) |
| ***H01F 27/28*** | (2006.01) |
| ***H01F 41/04*** | (2006.01) |
| ***H01F 27/32*** | (2006.01) |

(58) Field of Classification Search
USPC ..... 336/200, 205, 208, 222, 232; 29/602.1; 257/531
See application file for complete search history.

(56) References Cited

U.S. PATENT DOCUMENTS

| | | | | |
|---|---|---|---|---|
| 6,147,583 | A * | 11/2000 | Rinne et al. | 336/200 |
| 6,175,293 | B1 * | 1/2001 | Hasegawa | H01F 1/15308 336/150 |
| 6,198,374 | B1 * | 3/2001 | Abel | H01F 17/0013 336/200 |
| 6,914,508 | B2 * | 7/2005 | Ferencz et al. | 336/200 |
| 6,980,074 | B1 * | 12/2005 | Jitaru | 336/200 |
| 7,012,481 | B2 * | 3/2006 | Maekawa | H01P 1/2135 333/134 |
| 7,248,138 | B2 * | 7/2007 | Chiang et al. | 336/200 |
| 7,292,126 | B2 * | 11/2007 | So | 336/200 |
| 7,795,995 | B2 * | 9/2010 | White | H01L 23/552 333/134 |
| 7,932,799 | B2 * | 4/2011 | Loef | H01F 27/10 336/200 |
| 7,956,714 | B2 * | 6/2011 | Ackermann et al. | 336/200 |
| 8,065,794 | B2 * | 11/2011 | En et al. | 29/847 |
| 8,258,910 | B2 * | 9/2012 | Herhold | 336/200 |
| 8,258,911 | B2 * | 9/2012 | Fouquet | H01F 19/08 336/170 |
| 8,310,327 | B2 * | 11/2012 | Willers et al. | 336/200 |
| 8,581,684 | B2 * | 11/2013 | Noire | H01F 17/0013 336/200 |
| 8,674,418 | B2 * | 3/2014 | Poddar et al. | 257/294 |
| 8,917,495 | B2 | 12/2014 | Shimadu et al. | |
| 2002/0057139 | A1 * | 5/2002 | Matsumura | H03H 3/00 333/185 |
| 2002/0075116 | A1 * | 6/2002 | Peels | H01F 17/0013 336/200 |
| 2004/0145440 | A1 | 7/2004 | Coates | |
| 2006/0214759 | A1 * | 9/2006 | Kawarai | H01F 17/0006 336/200 |
| 2007/0241839 | A1 * | 10/2007 | Taniguchi | H03H 7/09 333/185 |
| 2009/0243782 | A1 * | 10/2009 | Fouquet | H01F 19/04 336/200 |
| 2009/0245782 | A1 * | 10/2009 | Shirai | H04J 3/12 398/1 |
| 2010/0176660 | A1 * | 7/2010 | Fouquet | H01F 19/08 307/109 |
| 2010/0219926 | A1 | 9/2010 | Willers et al. | |
| 2010/0283557 | A1 * | 11/2010 | Taniguchi | H01P 1/20345 333/204 |
| 2011/0140824 | A1 | 6/2011 | Herhold | |

FOREIGN PATENT DOCUMENTS

| | | |
|---|---|---|
| GB | 2 295 728 A | 6/1996 |
| JP | 11-67552 | 3/1999 |
| JP | 2004-040025 | 2/2004 |
| JP | 2009-259922 | 11/2009 |
| KR | 20120035196 | 4/2012 |

OTHER PUBLICATIONS

Translation of Chinese Office Action and Search Report for CN Application No. 201280077889.2 mailed May 24, 2016, 19 pages.
Korean Office Action for KR 10-2015-7018559 with translation mailed Jul. 17, 2016, 9 pages.

* cited by examiner

PLANAR TRANSFORMER

CROSS REFERENCE TO RELATED APPLICATION

This application is a 35 U.S.C. §371 national stage application of PCT International Application No. PCT/EP2012/076119, filed on 19 Dec. 2012, the disclosure and content of which is incorporated by reference herein in its entirety.

TECHNICAL FIELD

Embodiments disclosed herein relate to the field of planar magnetic transformers and, in particular, the arrangement of the windings used for a planar magnetic transformer on a multi-layered printed circuit board.

BACKGROUND

Transformers are magnetic components that have many uses, such as for transforming voltages and for providing isolation between the circuits on the primary and secondary sides of the transformer.

Recently, planar magnetic components have become widely used in power electronic devices, such as switched mode power supplies (SMPSs). An example of an SMPS constructed with planar magnetic components is shown in FIG. 1.

A planar magnetic component comprises two pieces of magnetic material (usually referred to as "cores", but sometimes referred to as "half-cores") which are used with one or more flat coils (also referred to as turns) printed on a printed circuit board (PCB). Typically, one core is positioned above the one or more coils and a second, identical, core is positioned below the one or more coils, with the cores being connected together through at least one hole in the PCB.

Referring to FIG. 2, by way of example, the parts of a planar magnetic transformer are shown unassembled. An upper core 11 and a lower core 12 are provided respectively above and below a multi-layered PCB 13. Cores 11 and 12 are identical E-plane cores. The layers of the PCB comprise at least one hole to allow the central part of each core to extend into the PCB 13. Typically the PCB 13 would also contain holes, not shown in FIG. 2, to allow the outer wings of the "E" of each core to also extend into the PCB 13. Printed tracks on the layers of the PCB 13 provide coils round the centre part of the core as well as input and output connections to the transformer. The coils on each layer either provide a winding for the primary side of the transformer or a winding for the secondary side.

The upper core 11 and the lower core 12 are attached to each other by the mechanical clip 14. In the arrangement shown in FIG. 2, the mechanical clip 14 extends around the edges of the PCB 13 and the ends of the mechanical clip 14 are attached to the recesses 15, 16 in the top surface of the upper core 11. Although a single mechanical clip is shown, two mechanical clips may alternatively have been used with separate clips attaching to respective ends of the upper and lower cores. The two cores may alternatively have been glued together instead of mechanical clips being used.

For a planar magnetic transformer, primary and secondary windings are provided by using a multi-layered PCB such as the arrangement shown in FIG. 2. In the arrangement shown in FIG. 2, a plurality of coils, or turns, are provided on each layer of the PCB. Alternatively, only a single coil, or turn, may be used on each layer.

The transformer shown in FIG. 2 has the layers comprising printed tracks, that provide the coils of the transformer, fully interleaved. That is to say, for layers within the structure (i.e. those between the top and bottom layers), each layer that provides a coil of the primary windings of the transformer is directly adjacent, i.e. above and below, two layers that provide coils of the secondary side of a transformer. Similarly, each layer that provides a coil of the secondary side of the transformer is directly adjacent to layers that provide coils of the primary side of the transformer. In this way, no layer providing a primary winding is adjacent another layer providing a primary winding. Similarly, no layer providing a secondary winding is adjacent another layer providing a secondary winding.

It is known to fully interleave the windings of the primary and secondary sides of a planar transformer. Fully interleaving the windings of the primary and secondary sides of the planar transformer improves the magnetic coupling between the primary and secondary sides and reduces flux leakage compared to an arrangement in which there is no interleaving between the primary and secondary windings.

FIG. 3 is a vertical cross-section of a multi-layered PCB showing the windings of a fully interleaved transformer with twelve layers. The outer layers (i.e. the top and bottom layers in FIG. 3) each have a metal thickness $t_o$. The inner layers each have a metal thickness $t_i$, with $t_i$ greater than $t_o$. The metal used to form the layers is typically copper.

Between each pair of the metal layers electrical isolation is provided. The isolation material is typically a plastic substrate. The thickness of the isolation material between the layers is $h_h$. FIG. 3 shows a known arrangement in which the spacing $h_h$ between each of the layers is the same throughout the vertical cross-section of the PCB.

A problem experienced by the fully interleaved PCB shown in FIG. 3 is that the parasitic capacitive coupling between the primary and secondary windings is large. A way of reducing the parasitic capacitive coupling is to increase the thickness of the isolation material between the layers so that the metal layers within the PCB are spaced further apart from each other. However, increasing the spacing between the layers results in the parasitic leakage inductance increasing.

Another requirement of such a planar magnetic transformer is for it to maintain good isolation between the primary and secondary sides of the transformer. The isolation material and spacing between the primary and secondary windings must therefore provide the required isolation properties of the transformer. A standard isolation voltage is 2250V between the primary and secondary sides. This imposes strict requirements on the isolation material and the distances between the primary and secondary windings.

A known manufacturing process of a multi-layered PCB for a planar magnetic transformer is described below with reference to FIG. 4.

A solid plastic substrate, also referred to as a laminate, is typically used as the isolation material. Tracks of the PCB are formed on the upper and lower surfaces from the substrate either by a subtractive process from a substrate with upper and lower surfaces entirely covered by metal or by an, additive process onto a substrate without metal coverings on its upper and lower surfaces.

Several such substrates are then bonded together by applying a fluid pre-preg and then applying pressure and heat.

The upper and lower layers of the PCB are then added using a pre-preg process again and forming the thinner upper and lower metal layers thereon.

Holes are then drilled in the PCB for vias between the layers and, if not already present, cuts are made to allow the core and wings of a transformer to extend into the PCB. The via holes are then electro-plated to form vias.

FIG. 4 shows a vertical cross-section of an entire PCB at stages during the manufacture of a PCB with six metal layers.

In FIG. 4, process 1 shows the bonding between multiple substrates, with metal tracks on their upper and lower surfaces, with pre-prep. Process 2 shows the subsequent adding of the upper and lower metal surfaces of the PCB.

Throughout the present document, the thickness of a layer is the dimension of a layer in a direction that is normal to the upper or lower surface of one of the planar layers.

As is clear from FIG. 4, the layers of pre-preg are thicker than those of the substrate.

Layers formed by a pre-preg process cannot be formed as thin as layers of substrate due to the nature of the pre-preg process.

Standard manufacturing processes have a ±10% tolerance on the thickness of the layers.

With standard manufacturing processes, the minimum substrate thickness that can be designed for is about 100 μm and the minimum pre-preg thickness that can be designed for is about 150 μm. Thus, the minimum actual substrate and pre-preg thicknesses may be as low as 90 μm and 135 μm, respectively, due to the ±10% manufacturing tolerance.

The average thickness of the pre-preg layer is required to be thicker than that of the substrate layer in order for it to be possible for the pre-preg to fill in the gaps between the printed tracks in the metal layers.

In order to provide an isolation voltage of 2250V between the primary and secondary sides of the transformer, the pre-preg isolation material should be designed to have a minimum thickness of 175 μm. That is to say, due to the manufacturing tolerance, the pre-preg isolation material meets the 2250V requirement if it has a thickness of at least 157.5 μm.

Accordingly, the isolation material in the fully interleaved transformer shown in FIG. 3 must be designed to be at least 175 μm thick, $h_h \geq 175$ μm, and the minimum manufacturable thicknesses of substrate and pre-preg cannot be used.

With regard to the thickness of the metal layers, this is specified in terms of ounces of copper, where:

$$\begin{aligned} 1\ \text{oz} &= \text{the thickness of 1 ounce of copper when rolled out over an area of 1 ft}^2 \\ &= 35\ \mu\text{m} \end{aligned}$$

In FIG. 3, $t_o$=2 oz and ti=4 oz.

Throughout the present document the height of a PCB is the dimension of the PCB in a direction normal to the upper or lower surface of one of the planar layers.

The total height of the PCB shown in FIG. 3 is:

$$\begin{aligned} H1 &= (10 \times 4\ \text{oz}) + (2 \times 2\ \text{oz}) + (11 \times 175\ \mu\text{m}) \\ &= 3.465\ \text{mm} \end{aligned}$$

A problem with the above-described known arrangement of a fully interleaved stacked-up multi-layered PCB, is that the height of the PCB is relatively large and this results in poor thermal conductivity from the transformer.

In addition, increasing the metal thickness, or number of layers, will increase the total height of the PCB further and thereby reduce the thermal conductivity even more. Poor thermal conductivity results in the planar magnetic transformer being unsuitable for high power applications.

SUMMARY

Embodiments provide multi-layered PCBs for planar magnetic transformers that overcome some or all of the above-identified problems.

An embodiment provides a multi-layered printed circuit board, PCB, for providing first turns for a first side of a planar magnetic transformer and second turns for a second side of the planar magnetic transformer, the multi-layered PCB comprising: a plurality of conductive layers configured to provide the first turns; a plurality of conductive layers configured to provide the second turns; and a plurality of layers of an isolation material; wherein: each layer of isolation material is arranged between two conductive layers so as to provide electrical isolation between said two conductive layers; and a group of two or more adjacent conductive layers are all conductive layers of the first turns and are all arranged between conductive layers of the second turns, wherein the thickness of the isolation material between at least a pair of adjacent conductive layers in the group of layers of the first turns is less than the thickness of the isolation material between a conductive layer of the second turns and a conductive layer of the first turns.

As a result of these features, the height of the PCB is lower than with known designs since the thickness of at least one of the layers within the PCB has been reduced. The reduced height of the PCB improves the thermal conductivity of the PCB. The parasitic capacitive coupling between the first turns and the second turns is also lower than with the known fully interleaved design. Although not fully interleaved, the turns of the first and second sides remain partially interleaved and so good magnetic coupling between the primary and secondary sides is maintained.

Optionally, a group of two or more adjacent conductive layers are all conductive layers of the second turns and are all arranged between conductive layers of the first turns, wherein the thickness of the isolation material between at least a pair of adjacent conductive layers in the group of layers of the second turns is less than the thickness of the isolation material between a conductive layer of the first turns and a conductive layer of the second turns.

Advantageously, by grouping adjacent layers together on both sides of the transformer, the height of the PCB can be reduced further, the thermal conductivity can be improved further and the parasitic capacitance can be reduced further.

Optionally, the plurality of conductive layers are arranged in at least four groups such that: a first group of two or more adjacent conductive layers are all conductive layers of the first turns and are all arranged between conductive layers of the second turns, wherein the thickness of the isolation material between at least a pair of adjacent conductive layers in the first group of layers of the first turns is less than the thickness of the isolation material between a conductive layer of the second turns and a conductive layer of the first turns; a second group of two or more adjacent conductive layers, that does not comprise a layer in the first group of two or more adjacent conductive layers, are all conductive layers of the first turns and are all arranged between conductive layers of the second turns, wherein the thickness of the isolation material between at least a pair of adjacent conductive layers in the second group of layers of the first turns is less than the thickness of the isolation material between a conductive layer of the second turns and a conductive layer of the first turns; a third group of two or more adjacent conductive layers are all conductive layers of the second turns and are all arranged between conductive layers of the first turns, wherein the thickness of the isolation material between at least a pair of adjacent conductive layers in the third group of layers of the second turns is less than the thickness of the isolation material between a conductive layer of the first turns and a conductive layer of the second turns; and a fourth group of two or more adjacent conductive layers, that does not comprise a layer in the third group of two or more adjacent conductive layers, are all conductive layers of the second turns and are all arranged between conductive layers of the first turns, wherein the thickness of the isolation material between at least a pair of adjacent conductive layers in the fourth group of layers of the second turns is less than the thickness of the isolation material between a conductive layer of the first turns and a conductive layer of the second turns.

Advantageously, by grouping adjacent layers together in more than one group on both sides of the transformer, good magnetic coupling is maintained, the height of the PCB can be reduced further, the thermal conductivity can be improved further and the parasitic capacitance can be reduced further.

Optionally, a pair of two adjacent conductive layers of the first turns have a laminate provided between the adjacent conductive layers as the isolation material and the conductive layers are formed on the laminate.

Advantageously, by forming the conductive layers on a laminate, the spacing between the conductive layers can be made small and the height of the PCB reduced further.

Optionally, a pair of two adjacent conductive layers of the second turns have a laminate provided between the adjacent conductive layers as the isolation material and the conductive layers are formed on the laminate; and, optionally, a pair of two adjacent conductive layers of the first turns have a laminate provided between the adjacent conductive layers as the isolation material and the conductive layers are formed on the laminate.

Advantageously, by forming as many conductive layers as possible on a laminate, the spacing between the conductive layers can be as small as possible with standard manufacturing techniques and the height of the PCB reduced further.

Optionally, the isolation material between a conductive layer of the first turns and a conductive layer of the second turns is pre-preg.

Optionally the thickness of the laminate has a value in the range of 90 μm to 110 μm; and the thickness of the pre-preg is has a value in the range of 157.5 μm to 192.5 μm.

Advantageously, the isolation requirements between the primary and secondary sides of the transformer are maintained.

The above-described first turns may be the turns of the primary side of a transformer and the second turnings may be the turns of the secondary side of the transformer.

Alternatively, the above-described first turns may be the turns of the secondary side of a transformer and the second turns may be the turns of the primary side of the transformer.

A further embodiment provides a method of manufacturing a multi-layered printed circuit board, PCB, comprising a plurality of layers for providing the first turns of a first side of a planar magnetic transformer and second turns of a second side of the planar magnetic transformer, the method comprising: forming a group of at least two conductive layers, wherein adjacent conductive layers of the group are separated from each other by a layer of an isolation material; forming at least one conductive layer above the group of conductive layers wherein the at least one conductive layer is separated from a conductive layer of the group by a layer of isolation material; forming at least one further conductive layer below the group of conductive layers, wherein the at least one further conductive layer is separated from a conductive layer of the group by a layer of isolation material; connecting all of the conductive layers in the group of conductive layers so that all of the conductive layers provide first turns; and connecting both said at least one conductive layer and said at least one further conductive layer to provide second turns; wherein the thickness of the isolation material between at least a pair of adjacent conductive layers in the group of conductive layers of the first turns is less than the thickness of the isolation material between a conductive layer of the second turns and a conductive layer of the first turns.

Advantageously, the height of the manufactured PCB is lower than with known designs since the thickness of at least one of the layers within the PCB has been reduced. The reduced height of the PCB improves the thermal conductivity of the PCB. The parasitic capacitive coupling between the first turns and the second turns is also lower than with the known fully interleaved design. Although not fully interleaved, the turns of the first and second sides remain partially interleaved and so the magnetic coupling between the primary and secondary sides is good.

Optionally, forming the group of at least two conductive layers comprises: forming two adjacent conductive layers of the group of conductive layers on the upper and lower surfaces of a laminate, wherein the laminate provides the isolation material between the adjacent conductive layers and the thickness of the laminate is less than the thickness of the isolation material between a conductive layer of the second turns and an adjacent conductive layer of the first turns.

Advantageously, by forming the conductive layers on a laminate, the spacing between the conductive layers can be as small as possible with standard manufacturing techniques and the height of the PCB reduced further.

Optionally, forming the group of at least two conductive layers further comprises: forming two adjacent conductive layers of the group of conductive layers on the upper and lower surfaces of a second laminate, wherein the second laminate provides the isolation material between the two conductive layers; and bonding a conductive layer of the second laminate to a conductive layer of the other laminate so that the conductive layers are separated by a layer of isolation material, wherein the isolation material between the conductive layers of the group is thicker than the laminates and is less than the thickness of the isolation material between a conductive layer of the second turns and an adjacent conductive layer of the first turns.

Advantageously, a group of four adjacent layers all of the same side of the transformer is formed with a minimum total spacing between the layers.

Optionally, the method further comprises bonding a further conductive layer to a conductive layer of the two adjacent conductive layers of the first turns to form a group of three adjacent conductive layers of the first windings with a layer of isolation material separating all adjacent conductive layers, wherein the isolation material between the further conductive layer and said two adjacent conductive layers is thicker than the laminate and less thick than the isolation material between a conductive layer of the second turns and an adjacent conductive layer of the first turns.

Advantageously, a group of three adjacent layers all of the same side of the transformer is formed with a minimum total spacing between the layers.

Optionally, the bonding of conductive layers is performed using a pre-preg process and provides pre-preg as the isolation material between the bonded layers; and the multi-layered PCB manufactured according to the above method has a thickness of laminate in a range of 90 μm to 110 μm; a thickness of the pre-preg between adjacent conductive layers of the first turns in a range of 135 μm to 165 μm; and a thickness of the pre-preg between the conductive layer of the first turns and the adjacent conductive layer of the second turns in a range of 157.5 μm to 192.5 μm.

Advantageously, the thickness of the isolation material within the PCB provides the lowest height of PCB possible with standard manufacturing techniques.

The multi-layered PCB manufactured according to the above-described method may have first turns that are the turns of the primary side of a transformer and second turns that are the turns of the secondary side of the transformer.

Alternatively, the multi-layered PCB manufactured according to the above-described method may have first turns that are the turns of the secondary side of a transformer and second turns that are the turns of the primary side of the transformer.

BRIEF DESCRIPTION OF THE DRAWINGS

Embodiments will now be explained, by way of example only, with reference to the accompanying figures in which.

DESCRIPTION

Embodiments provide a winding arrangement of a planar magnetic transformer formed on a multi-layered PCB. The winding arrangement according to embodiments improves the thermal transfer from the transformer so that the transformer can be used for higher power applications than known planar transformer designs.

A lower height of PCB is also realisable.

In addition, the parasitic capacitive coupling in the transformer is lower than the known fully interleaved transformer design. The leakage inductance is not significantly increased from the known fully interleaved transformer design and good magnetic coupling between the primary and secondary sides is maintained.

Embodiments realise the above advantages by reducing the thickness of some of the isolating layers within the PCB.

This allows a reduced height of PCB, and/or an increased thickness of the metal layers within the PCB and/or an increased number of metal layers.

According to embodiments, the way in which the windings of the primary and secondary sides of the transformer are interleaved is changed compared to known arrangements.

FIGS. 5 to 8 show vertical cross-sections of multi-layered PCBs according to embodiments.

Figure 1:
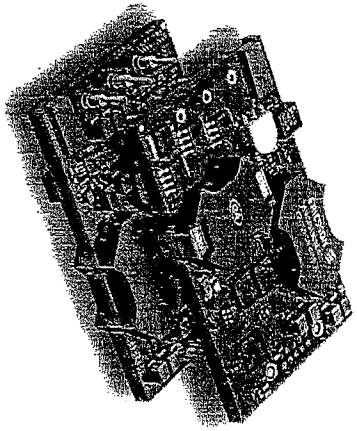
FIG. 1 shows a typical construction of a SMPS using planar magnetic components.
Figure 2:
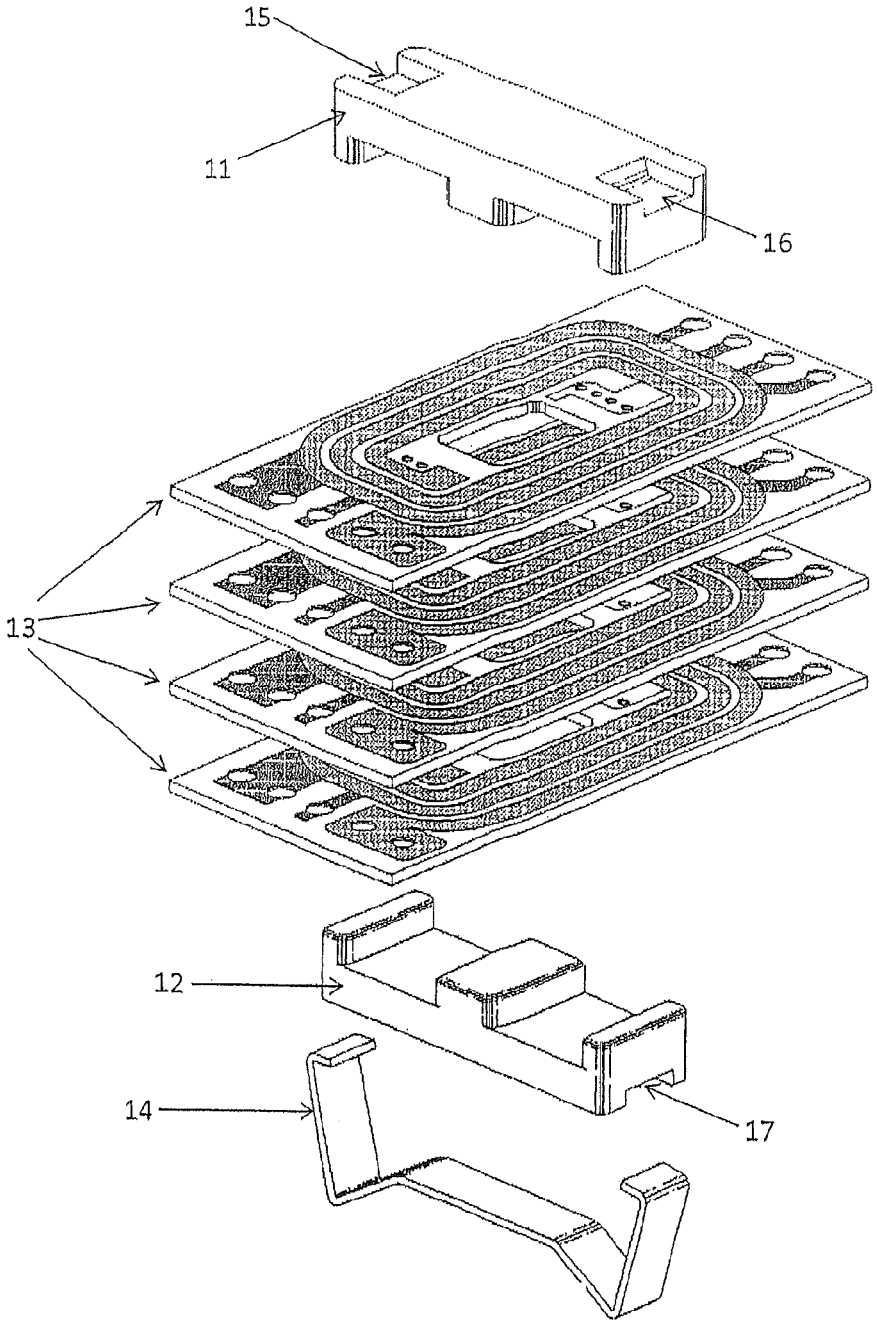
FIG. 2 is a diagram showing unassembled parts of a known planar magnetic transformer.
Figure 3:
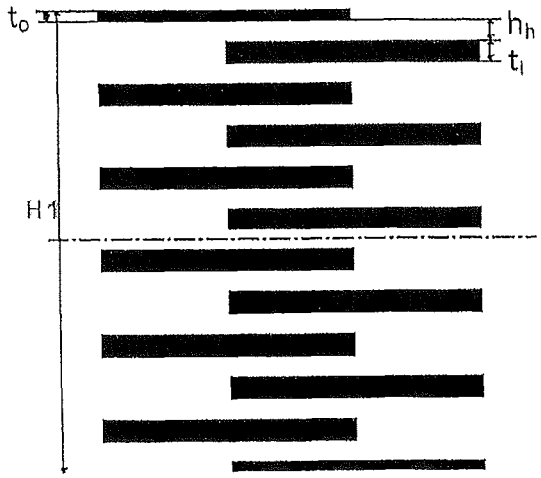
FIG. 3 is a vertical cross-section of a known fully interleaved twelve layer PCB.
Figure 4:
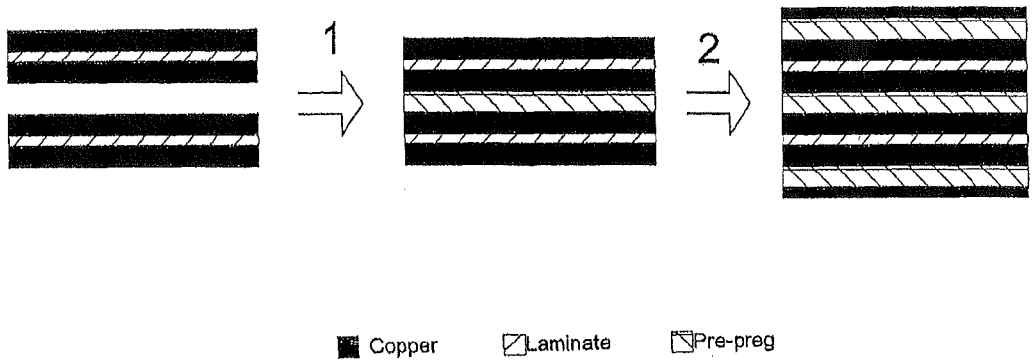
FIG. 4 is a diagram showing a known multi-layered PCB at different stages during its manufacturing process.

In embodiments, the windings of the primary and secondary sides are not fully interleaved as with the known transformer designs shown in FIGS. 2 and 3.

Instead two or more layers forming windings for the same side of the transformer are arranged adjacent to each other in a group. This group is then interleaved between a layer, or group of layers, forming windings for the other side of the transformer. The thickness of the isolation material between the layers of a group is made lower than the layer spacing with the known fully interleaved design. As will be explained in more detail later, it is possible to reduce the thickness of the isolation material between the conductive layers of a group since the layers in the group all provide windings for the same side of the transformer and the spacing between these layers is less restricted by the requirement to ensure that electrical isolation is maintained between the layers than adjacent layers on different sides of the transformer.

When a group is formed, preferably the metal layers within the group are based on a substrate providing the isolation material. Advantageously, using a substrate allows a thinner isolation material to be realised, since the structure is formed by plating a substrate, or removing metal from a plated substrate, rather than using a pre-preg processes.

The metal used for the metal layers of the multi-layered PCB may be copper.

FIGS. 5 to 8 show three different arrangements of layers according to embodiments.

Figure 5:
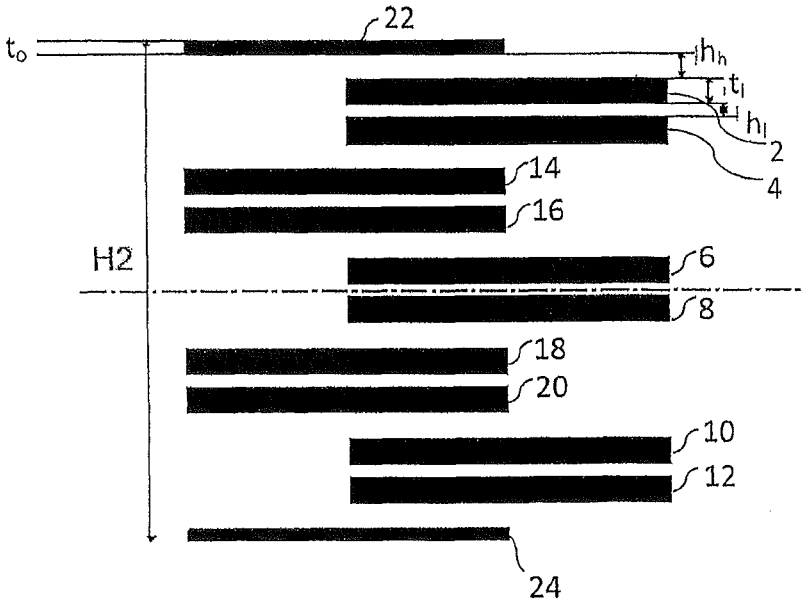
FIG. 5 shows a vertical cross-section of a multi-layered PCB according to an embodiment.
Figure 6:
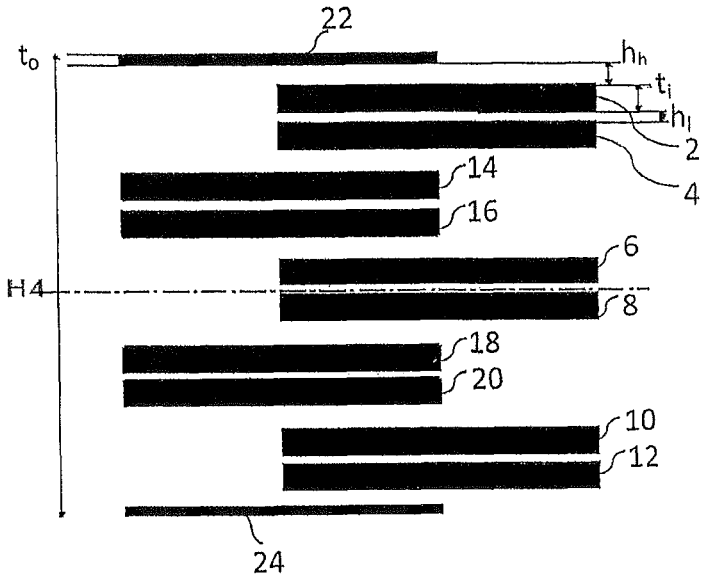
FIG. 6 shows a vertical cross-section of a multi-layered PCB according to an embodiment.

FIGS. 5 and 6 show an embodiment in which the layers of the primary and secondary sides are arranged in groups of two within the PCB, with just single layers being provided as the upper and lower layers.

Thus, for example, each of the layers 2, 4, 6, 8, 10 and 12 provides one or more windings for the primary side of the transformer, while each of the layers 14, 16, 18 and 20 provides one or more windings for the secondary side of the transformer. Layers 22 and 24 are single layers, each providing one or more windings for the secondary side. Thus, the layers 2 and 4 constitute a first group of layers for the primary side, layers 6 and 8 constitute a second group of layers for the primary side, and layers 10 and 12 constitute a third group of layers for the primary side. The layers 14 and 16 constitute a first group of layers for the secondary side, and the layers 18 and 20 constitute a second group of layers for the secondary side. The first and second groups for the secondary side are interleaved with the first, second and third groups for the primary side. In the embodiments of FIGS. 5 and 6, each group comprises two layers. However, as will be explained below, each group may contain two or more layers, and the number of layers in each group need not be the same.

Advantageously, within each group, the two layers can be formed on upper and lower surfaces of a substrate without the increased thickness of pre-preg being used between each layer.

Since the metal layers within each group all provide windings on the same side of the transformer, the potential difference between the metal layers is relatively small and there is little capacitive coupling between them. There is still a need to maintain isolation between the metal layers within each group but the required isolation is typically 500V, which allows a closer layer spacing than the isolation voltage of 2250V that should be provided between layers on different sides the transformer.

Accordingly, the spacing between metal layers within a group can be made lower than the spacing between metal layers that provide windings on different sides of the transformer, which is restricted by the capacitive coupling and the more restrictive requirement for ensuring that isolation is provided. In FIGS. 5 to 8 the spacing between adjacent layers that provide windings on different sides of the transformer is therefore restrained by the same isolation requirements as the spacing $h_h$ in FIG. 3.

In FIG. 5, the uppermost and lowermost metal layers have a thickness $t_o$ of 2 oz and the inner metal layers have a thickness, $t_i$, of 4 oz. The thickness of the substrate $h_l$ between metal layers providing coils on the same side of the transformer is the minimum designable thickness of 100 μm, and therefore in practice is in the range 90 μm to 110 μm due to ±10% manufacturing tolerance. The isolation material $h_h$ between metal layers providing coils on different sides of the transformer is provided by pre-preg and, due to the 2250V isolation requirement, is designed to be 175 μm and therefore in practice is in the range 157.5 μm to 192.5 μm due to ±10% manufacturing tolerance.

The total height of the PCB in FIG. 5 is therefore:

$$\begin{aligned} H2 &= (10\times t_i)+(2\times t_o)+(6\times h_h)+(5\times h_1) \\ &= (10\times 4\text{ oz})+(2\times 2\text{ oz})+(6\times 175\ \mu\text{m})+(5\times 100\ \mu\text{m}) \\ &= 3.090\text{ mm} \end{aligned}$$

The arrangement in FIG. 5 therefore provides a twelve layer multi-layered PCB with a lower height than the known arrangement shown in FIG. 3, since the spacing between some of the layers within the PCB has been reduced. Advantageously, this improves the thermal conductivity of the PCB as well as reduces the parasitic capacitance. Although the leakage inductance has increased, the increase is not significant and good magnetic coupling between the different sides of the transformer is maintained.

The arrangement shown in FIG. 6 uses thicker metal layers than that of FIG. 5 and may be designed to have about the same PCB height as the known multi-layered PCB shown in FIG. 3. The embodiment shown in FIG. 6 advantageously has lower resistance since the metal layers are thicker.

In FIG. 6, the only difference from the PCB shown in FIG. 5 is that the thickness of the inner metal layers, $t_{i2}$, has been increased to 5 oz.

The height of the PCB shown in FIG. 6 is therefore:

$$\begin{aligned} H4 &= (10\times t_{i2})+(2\times t_o)+(6\times h_h)+(5+h_1) \\ &= (10\times 5\text{ oz})+(2\times 2\text{ oz})+(6\times 175\ \mu\text{m})+(5\times 100\ \mu\text{m}) \\ &= 3.440\text{ mm} \end{aligned}$$

Figure 7:
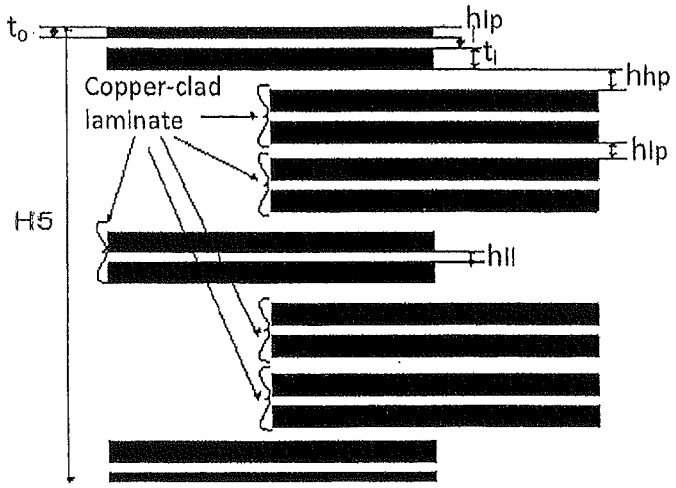
FIG. 7 shows a vertical cross-section of a multi-layered PCB according to an embodiment.
Figure 8:
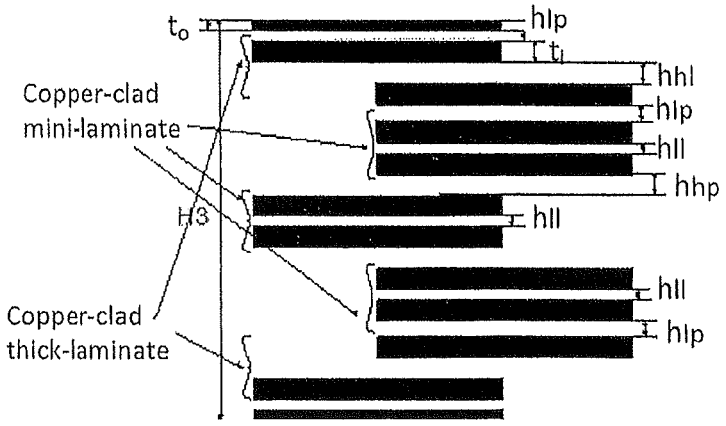
FIG. 8 shows a vertical cross-section of a multi-layered PCB according to an embodiment.

FIGS. 7 and 8 show other possible arrangements in which the number of layers in groups on the primary and secondary sides is different. In each case, however, each group of layers comprises at least two layers providing windings for the same respective side of the transformer. These arrangements of layers can be used to realise PCBs with lower heights than those shown in FIGS. 5 and 6 since, for a given number of metal layers, the number of layers of isolation material adjacent to a metal layer of the primary side and a metal layer of the secondary side is reduced, and more of the layers of the isolation material can be provided by thinner isolation material.

FIG. 7 shows a fourteen layer PCB with the primary side comprising groups of two layers and the secondary side comprising groups of four layers.

Each group of four layers comprises substrates with the minimum substrate thickness, $h_{ll}$, clad on both sides with copper. The two copper clad substrates in each group are bonded together using a pre-preg process that provides the minimum designable thickness of pre-preg, $h_{lp}$, of 150 μm (which in practice is between 135 μm to 165 μm due to ±10% manufacturing tolerance).

The total height of the PCB in FIG. 7 is:

$$\begin{aligned} H5 &= (12\times t_i)+(2\times t_o)+(4\times h_{hp})+(5\times h_{11})+(4\times h_{1p}) \\ &= (12\times 4\text{ oz})+(2\times 2\text{ oz})+(4\times 175\ \mu\text{m})+(5\times 100\ \mu\text{m})+ \\ &\quad (4\times 150\ \mu\text{m}) \\ &= 3.620\text{ mm} \end{aligned}$$

FIG. 8 shows another configuration of a twelve layer PCB. The primary side has three groups each comprising two layers, while the secondary side has two groups, each comprising three layers.

Each group of three layers is constructed by forming two of the layers on either side of a substrate with the minimum designable thickness, $h_{ll}$, and then providing a layer of pre-preg with the minimum designable thickness, $h_{lp}$, between a metal layer formed on the substrate and a third metal layer.

The total height of the PCB in FIG. 8 is:

$$\begin{aligned} H3 &= (10\times t_i)+(2\times t_o)+(3\times h_{11})+(2\times h_{h1})+(4\times h_{1p})+(2\times h_{hp}) \\ &= (10\times 4\text{ oz})+(2\times 2\text{ oz})+(3\times 100\ \mu\text{m})+(2\times 175\ \mu\text{m})+ \\ &\quad (4\times 150\ \mu\text{m})+(2\times 175\ \mu\text{m}) \\ &= 3.140\text{ mm} \end{aligned}$$

The arrangements shown in FIGS. 7 and 8 are particularly suitable for high voltage applications, such as 400V applications where the isolation requirement is 5000V, for example, in which a larger designed spacing than 175 μm between layers on different sides of the transformer is required in order to meet the isolation requirements. The isolation material between all of the metal layers may be provided by pre-preg, the advantages of embodiments being realised by a thinner thickness of pre-preg being used between adjacent layers within a group.

Figure 9:
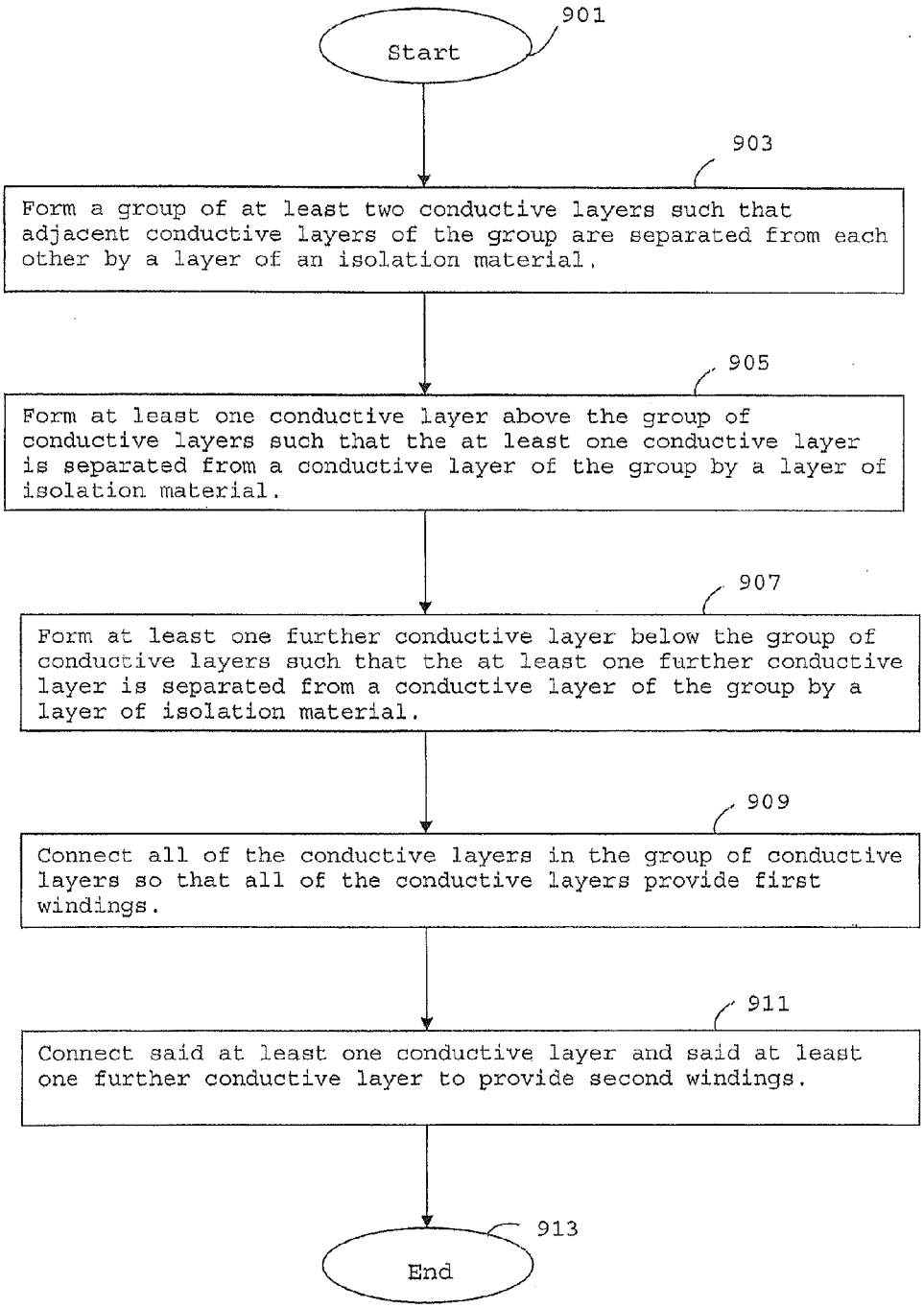
FIG. 9 is a flow chart showing operations performed in a method according to an embodiment.

FIG. 9 shows the operations performed in a method of manufacturing a multi-layered PCB according to an embodiment.

The manufacturing process starts at step 901.

In step 903 a group of at least two conductive layers 6, 8, are formed, wherein adjacent conductive layers of the group are separated from each other by a layer of an isolation material.

In step 905 at least one conductive layer 16 above the group of conductive layers is formed, wherein the at least one conductive layer 16 is separated from a conductive layer of the group by a layer of isolation material.

In step 907 at least one further conductive layer 18 below the group of conductive layers is formed, wherein the at least one further conductive layer 18 is separated from a conductive layer of the group by a layer of isolation material.

In step 909 all of the conductive layers in the group of conductive layers 6, 8 are connected so that all of the conductive layers provide first windings.

In step 911 said at least one conductive layer 16 and said at least one further conductive layer 18 are connected to provide second windings.

In multi-layered PCBs manufactured according to the above method, the thickness of the isolation material between at least a pair of adjacent conductive layers in the group of conductive layers 6, 8 of the first windings is less than the thickness of the isolation material between a conductive layer 16 of the second windings and a conductive layer 6 of the first windings.

Other arrangements of the metal layers than those shown in FIGS. 5 to 8 are possible for realising advantages of the embodiments so long as at least one side of the transformer has at least two adjacent metal layers providing coils for that side of the transformer without a coil from the other side interleaved between the two metal layers. The groups of metal layers may comprise any number of layers and are not restricted to two, three or four as shown in FIGS. 5 to 8.

The total turns ratio of the transformer is determined by the number of parallel layers used and number of coils on each layer. The arrangement shown in FIG. 5, for example, may be designed to have a 4:1 turns ratio.

Since the thickness of the isolation material between some of the layers within the multi-layered PCB structure is reduced, the thermal transfer of the transformer is improved. The parasitic capacitive coupling between the primary and secondary sides is also reduced.

The gain of the planar magnetic transformer according to embodiments is particularly large when adjacent layers of a group provide the same coil of a winding. By using two or more adjacent layers to provide the same coil, or turn, the resistance is decreased.

The spacing between adjacent layers of a group may be provided by forming the metal layers on a substrate. This allows a lower isolation material thickness than that realisable with a pre-preg layer.

In the example shown in FIG. 5, the thickness of the isolation material has been reduced from 175 μm to 100 μm between adjacent layers within a group. The height of the PCB is about 10% less than the known arrangement shown in FIG. 3. The thermal resistance is also reduced by 18% without any increase in parasitic capacitance or leakage inductance.

Advantageously, transformers with a lower height may be realised for a given power requirement.

The embodiment shown in FIG. 6 has a resistance that is 19% lower than the design shown in FIG. 3 and also has a thermal resistance that is 18% lower. Accordingly, the transformer design according to the embodiment has about the same mechanical outer dimensions as the known transformer shown in FIG. 3 but can operate at powers 20% higher. The improvement is provided by the thicker metal tracks resulting in lower resistance and also providing an improved thermal conductivity.

Many modifications and variations may be made to the embodiments described above without departing from the scope of the invention as defined by the appended claims.

The invention claimed is:

1. A multi-layered printed circuit board, PCB, for providing coplanar first windings for a first side of a planar magnetic transformer and coplanar second windings for a second side of the planar magnetic transformer, the multi-layered PCB comprising:

a plurality of coplanar conductive layers configured to provide the coplanar first windings;

a plurality of coplanar conductive layers configured to provide the coplanar second windings; and a plurality of layers of an isolation material;

wherein:

each layer of the isolation material is arranged between an adjacent pair of the coplanar conductive layers to provide electrical isolation between said adjacent pair of the coplanar conductive layers, a group of two or more adjacent coplanar conductive layers are all coplanar conductive layers of the coplanar first windings and are all arranged between coplanar conductive layers of the coplanar second windings, wherein the thickness of the isolation material between at least one of the adjacent pairs of the coplanar conductive layers in the group of layers of the coplanar first windings is less than the thickness of the isolation material between a conductive layer of the coplanar second windings and a conductive layer of the coplanar first windings, the isolation material comprises a substrate that is between an adjacent pair of the coplanar conductive layers of the coplanar second windings, the isolation material between a conductive layer of the coplanar first windings and a conductive layer of the coplanar second windings comprises pre-preg, and the thickness of the substrate has a value in the range of 90 μm to 110 μm and the thickness of the pre-preg has a value in the range of 157.5 μm to 192.5 μm.

2. The multi-layered PCB according to claim 1, wherein:

a group of two or more adjacent coplanar conductive layers are all coplanar conductive layers of the coplanar second windings and are all arranged between coplanar conductive layers of the coplanar first windings; and the thickness of the isolation material between at least a pair of adjacent coplanar conductive layers in the group of layers of the coplanar second windings is less than the thickness of the isolation material between a conductive layer of the coplanar first windings and a conductive layer of the coplanar second windings.

3. The multi-layered PCB according to claim 2, the multi-layered PCB wherein the plurality of coplanar conductive layers are arranged in at least four groups such that:

a first group of two or more adjacent coplanar conductive layers are all coplanar conductive layers of the coplanar first windings and are all arranged between coplanar conductive layers of the coplanar second windings, wherein the thickness of the isolation material between at least a pair of adjacent coplanar conductive layers in the first group of layers of the coplanar first windings is less than the thickness of the isolation material between a conductive layer of the coplanar second windings and a conductive layer of the coplanar first windings;

a second group of two or more adjacent coplanar conductive layers, that does not comprise a layer in the first group of two or more adjacent coplanar conductive layers are all coplanar conductive layers of the coplanar first windings and are all arranged between coplanar conductive layers of the coplanar second windings, wherein the thickness of the isolation material between at least a pair of adjacent coplanar conductive layers in the second group of layers of the coplanar first windings is less than the thickness of the isolation material between a conductive layer of the coplanar second windings and a conductive layer of the coplanar first windings;

a third group of two or more adjacent coplanar conductive layers are all coplanar conductive layers of the coplanar second windings and are all arranged between coplanar conductive layers of the coplanar first windings, wherein the thickness of the isolation material between at least a pair of adjacent coplanar conductive layers in the third group of layers of the coplanar second windings is less than the thickness of the isolation material between a conductive layer of the coplanar first windings and a conductive layer of the coplanar second windings; and a fourth group of two or more adjacent coplanar conductive layers that does not comprise a layer in the third group of two or more adjacent coplanar conductive layers, are all coplanar conductive layers of the coplanar second windings and are all arranged between coplanar conductive layers of the coplanar first windings, wherein the thickness of the isolation material between at least a pair of adjacent coplanar conductive layers in the fourth group of layers of the coplanar second windings is less than the thickness of the isolation material between a conductive layer of the coplanar first windings and a conductive layer of the coplanar second windings.

4. The multi-layered PCB according to claim 1, wherein the adjacent pair of the coplanar conductive layers are on opposite sides of the substrate.

5. The multi-layered PCB according to claim 1, wherein the isolation material comprises a substrate that is between an adjacent pair of the coplanar conductive layers of the coplanar first windings, wherein the adjacent pair of the coplanar conductive layers are on opposite sides of the substrate.

6. The multi-layered PCB according claim 1 wherein the coplanar first windings are the windings of the primary side of a transformer and the coplanar second windings are the windings of the secondary side of the transformer; or the coplanar first windings are the windings of the secondary side of a transformer and the coplanar second windings are the windings of the primary side of the transformer.

7. A method of manufacturing a multi-layered printed circuit board, PCB, comprising a plurality of layers for providing the coplanar first windings of a first side of a planar magnetic transformer and coplanar second windings of a second side of the planar magnetic transformer, the method comprising:

forming a group of at least two coplanar conductive layers wherein adjacent coplanar conductive layers of the group are separated from each other by a layer of an isolation material;

forming at least one conductive layer above the group of coplanar conductive layers, wherein the at least one conductive layer is separated from a conductive layer of the group by a layer of isolation material;

forming at least one further conductive layer below the group of coplanar conductive layers, wherein the at least one further conductive layer is separated from a conductive layer of the group by a layer of isolation material;

connecting all of the coplanar conductive layers in the group of coplanar conductive layers so that all of the coplanar conductive layers provide coplanar first windings; and connecting said at least one coplanar conductive layer and said at least one further coplanar conductive layer to provide coplanar second windings;

wherein the thickness of the isolation material between at least a pair of adjacent coplanar conductive layers in the group of coplanar conductive layers of the coplanar first windings is less than the thickness of the isolation material between a conductive layer of the coplanar second windings and a conductive layer of the coplanar first windings, wherein the forming the group of at least two coplanar conductive layers comprises forming two adjacent coplanar conductive layers of the group of coplanar conductive layers on the upper and lower surfaces of a substrate, wherein the substrate provides the isolation material between the adjacent coplanar conductive layers and the thickness of the substrate is less than the thickness of the isolation material between a conductive layer of the coplanar second windings and an adjacent conductive layer of the coplanar first windings, wherein the bonding of coplanar conductive layers is performed using a pre-preg process and provides pre-preg as the isolation material between the bonded layers, wherein the thickness of the substrate has a value in the range of 90 μm to 110 μm, wherein the thickness of the pre-preg between adjacent coplanar conductive layers of the group has a value in the range of 135 μm to 165 μm, and wherein the thickness of the pre-preg between a conductive layer of the coplanar first windings and an adjacent conductive layer of the coplanar second windings has a value in the range of 157.5 μm to 192.5 μm.

8. The method of manufacturing a multi-layered PCB according to claim 7, wherein forming the group of at least two coplanar conductive layers further comprises:

forming two adjacent coplanar conductive layers of the group of coplanar conductive layers on the upper and lower surfaces of a second substrate, wherein the second substrate provides the isolation material between the two coplanar conductive layers; and bonding a conductive layer of the second substrate to a conductive layer of the other substrate so that the coplanar conductive layers are separated by a layer of isolation material, wherein the isolation material between the coplanar conductive layers of the group is thicker than the substrates and is less than the thickness of the isolation material between a conductive layer of the coplanar second windings and an adjacent conductive layer of the coplanar first windings.

9. The method of manufacturing a multi-layered PCB according to claim 7, further comprising:

bonding a further conductive layer to a conductive layer of the two adjacent coplanar conductive layers of the coplanar first windings to form a group of three adjacent coplanar conductive layers of the coplanar first windings with a layer of isolation material separating all adjacent coplanar conductive layers, wherein the isolation material between the further conductive layer and said two adjacent coplanar conductive layers is thicker than the substrate and less thick than the isolation material between a conductive layer of the coplanar second windings and an adjacent conductive layer of the coplanar first windings.

10. The method of manufacturing a multi-layered PCB according to claim 7 wherein the coplanar first windings are the windings of the primary side of a transformer and the coplanar second windings are the windings of the secondary side of the transformer; or the coplanar first windings are the windings of the secondary side of a transformer and the coplanar second windings are the windings of the primary side of the transformer.

* * * * *